US005092393A

United States Patent [19]

Suehiro et al.

[11] Patent Number: 5,092,393

[45] Date of Patent: Mar. 3, 1992

[54] PROCESS FOR PRODUCING COLD-ROLLED STRIPS AND SHEETS OF AUSTENITIC STAINLESS STEEL

[75] Inventors: Toshiyuki Suehiro; Hidehiko Sumitomo, both of Hikari; Masanori Ueda; Shigeru Ogawa, both of Kitakyushu, all of Japan

[73] Assignee: Nippon Steel Corporation, Tokyo, Japan

[21] Appl. No.: 492,560

[22] Filed: Mar. 12, 1990

[30] Foreign Application Priority Data

Mar. 14, 1989 [JP] Japan ..... 1-59780
Dec. 28, 1989 [JP] Japan ..... 1-338720

[51] Int. Cl.[5] ..... B22D 11/00

[52] U.S. Cl. ..... 164/476; 148/2; 29/527.7

[58] Field of Search ..... 164/476, 138, 428; 148/2; 29/527.7

[56] References Cited

U.S. PATENT DOCUMENTS 4,441,926 4/1984 Hiraishi et al. ..... 164/448
4,484,958 11/1984 Shintani et al. ..... 164/448
4,532,978 8/1985 Kuroki et al. ..... 164/448
4,951,736 8/1990 Yukumoto et al. ..... 164/428

FOREIGN PATENT DOCUMENTS 36041 2/1982 Japan ..... 164/428
56141 4/1982 Japan ..... 164/428

OTHER PUBLICATIONS

"Tetsu-to-Hagane", 1985, A197-A256.

*Primary Examiner*—Richard K. Seidel
*Attorney, Agent, or Firm*—Kenyon & Kenyon

[57] ABSTRACT

Disclosed is a process for the producing coldrolled strips and sheets of austenitic stainless steel, which comprises preparing a cast strip having a thickness not larger than 10 mm, which is composed of an austenitic stainless steel, by a continuous casting machine, in which the wall surface of a casting mold moves synchronously with the cast strip, and cold rolling the cast strip by a hard rolls having a surface hardness not lower than the Vickers hardness of 600. A preferred embodiment of the present invention is characterized in that crystal grains of the cast strip are made finer by cooling the cast strip at a cooling rate of at least 50° C./sec in the temperature range of from the temperature for initiation of solidification of the cast strip to 1200° C. and the cast strip is then coldrolled by the hard rolls, another preferred embodiment of the present invention is characterized in that the hard rolls are composed of a material having a Young's modulus of at least 30000 kgf/mm$^2$ and the cast strip is cold-rolled by such hard rolls, and another preferred embodiment of the present invention is characterized in that for cast strip which is descaled by pickling, especially with nitric and fluoric acid, prior to cold rolling, the cast strip is cooled at a cooling rate of at least 10° C./sec in the Cr carbide-precipitating temperature range of from 900° to 550° C.

7 Claims, 1 Drawing Sheet

PROCESS FOR PRODUCING COLD-ROLLED STRIPS AND SHEETS OF AUSTENITIC STAINLESS STEEL

BACKGROUND OF THE INVENTION

1. Field of the Invention

The present invention relates to a process for producing cold-rolled strips and sheets of austenitic stainless steel, which comprises cold-rolling a cast strip having a thickness close to the thickness of a product, which is cast by the synchronous continuous casting process in which there is no difference in the relative speed of the cast strip and the inner wall surface of a casting mold.

2. Description of the Related Art

According to the conventional process for producing cold-rolled strips and sheets of a stainless steel by the continuous casting method, a cast slab having a thickness 100 mm or more is formed by casting, while oscillating a casting mold in the casting direction, the obtained cast slab is surface-finished and is heated at a temperature 1000° C. or higher in a heating furnace, the heated slab is hot-rolled to a hot strip having a thickness of several millimeters by a hot strip mill comprising rough-rolling stands and finish-rolling stand, the hot strip is annealed or not annealed, and the strip is descaled, cold-rolled, and subjected to final annealing.

The conventional process has problems in that large and long hot strip mills are required to hot-roll a cast slab having a thickness of 100 mm or more, and that large quantity of heat is necessary for heating and rolling the cast slab.

As the means for overcoming these problems, a process for producing a cast strip having a thickness equivalent or close to the thickness of the hot strip has been studied. For example, there can be mentioned a synchronous continuous casting process where there is no difference in the relative speed of the cast strip and the inner wall surface of a casting mold, such as a twin-roll method and a twin-belt method, as introduced in these specially published in "Iron and Steel", '85-A197 to '85-A256.

In the production of cold-rolled stainless steel strips and sheets through this synchronous continuous casting process, however, problems remain to be solved. Namely, where cold-rolled stainless steel strip is produced through this continuous casting process, since the processes from casting to final product are shortened, problems arise with respect to the surface state of the product.

SUMMARY OF THE INVENTION

The inventors took note of austenitic stainless steels in which no problem arose with respect to the surface state of the product in the conventional process, and a melt of SUS 304, which is a typical example of austenitic stainless steel, was cast into a strip having a thickness of 1 to 5 mm by a twin-roll continuous casting machine of the internal water-cooling system, the cast strip was cold-rolled, a part of the cold-rolled strip was annealed and pickled to obtain 2B (dull finish) product, and another part of the cold-rolled strip was bright-annealed to obtain BA (bright finish) product. Furthermore, a continuously cast slab having a thickness of 100 mm or more was hot-rolled and cold-rolled, and 2B and BA products were prepared. When the surface states of these products were examined and compared in detail it was found surface defects, in the products obtained by using the twin-roll continuous casting machine, fine crepe-like undulations hereinafter referred to as ("roping") peculiarly generated through this process, and uneven gloss, were observed.

The present invention relates to a process for producing an austenitic stainless steel strips and sheets by cold-rolling a cast strip having a thickness close to the thickness of a product, which is cast by a synchronous continuous casting process in which there is no difference in the relative speed of the cast strip and the inner wall surface of a casting mold, and an object of the present invention is to provide a simple process capable of providing a product in which above-mentioned surface defects, such as roping and uneven gloss, do not appear.

More specifically, in accordance with the present invention, the above-mentioned object can be attained by a process for producing cold-rolled strips and sheets of austenitic stainless steel, which comprises preparing a cast strip having a thickness not larger than 10 mm, which is composed of an austenitic stainless steel, by a continuous casting machine, in which the wall surface of a casting mold moves synchronously with the cast strip, and cold rolling the cast strip by hard rolls having a surface hardness not lower than the Vickers hardness of 600.

One preferred embodiment of the present invention is characterized in that crystal grains of the cast strip are made finer by cooling the cast strip at a cooling rate of at least 50° C./sec in the temperature range of from the temperature for initiation of solidification of the cast strip to 1200° C., and the cast strip is then cold-rolled by the hard rolls.

Another preferred embodiment of the present invention is characterized in that the hard rolls are composed of a material having a Young's modulus of at least 30000 kgf/mm$^2$, and the cast strip is cold-rolled by such hard rolls.

Still another preferred embodiment of the present invention is characterized in that, when a cast strip which is descaled by pickling, especially with nitric and fluoric acid, prior to cold rolling, the cast strip is cooled at a cooling rate of at least 10° C./sec in the Cr carbide-precipitating temperature range of from 900° to 550° C.

Thus, the inventors clarified the causes of the occurrence of roping, and uneven gloss inherently observed in a product formed by cold-rolling a cast strip of an austenitic stainless steel formed by a twin-roll continuous casting machine, and have succeeded in providing a means for solving these problems.

More specifically, it was clarified that, since the size of $\gamma$ grains in the material before the cold rolling, i.e., the cast strip, is larger than that in the hot strip, roping is caused by the anisotropy of the plasticity in respective crystal grains at the cold rolling, and it was found that the occurrence of roping can be prevented by making $\gamma$ grains of the cast strip finer by selecting appropriate casting conditions and cooling conditions and using hard rolls having a surface hardness Hv of at least 600 at the cold rolling, or by using a hard roll composed of a material having a Young's modulus of at least 30,000 kgf/mm$^2$ and having a surface hardness Hv of at least 600 at the cold rolling for controlling undulation to be formed on the surface of the strip.

Furthermore, it was clarified that the uneven gloss occurs because intergranular corrosion on the surface caused by a precipitation of Cr carbide which has been pickled before the cold rolling, and the sizes of crystal grains distributed on the surface of the material before the cold rolling are irregular and uneven. It was found that this problem of the occurrence of the uneven gloss can be solved by selecting appropriate cooling conditions in the Cr carbide-precipitating temperature range at the time of cooling the cast strip at the casting step or cooling the cast strip after the annealing and then pickling the cooled cast strip. These causes and solving means hold good with respect to not only the process using the twin-roll continuous casting machine but also various continuous casting processes wherein the wall surface of a casting mold moves synchronously with the cast strip.

Namely, in the present invention, by the continuous casting machine wherein the wall surface of a casting mold moves synchronously with the cast strip are meant continuous casting machines for use in carrying out the single roll method, the twin-roll method, the internal ring method, the roll-belt method, the twin-belt method, the mold-moving continuous casting method and the spray roll method, as disclosed in "Iron and Steel"'85-A200 through '85-A203.

DESCRIPTION OF THE PREFERRED EMBODIMENTS

Figure 1A:
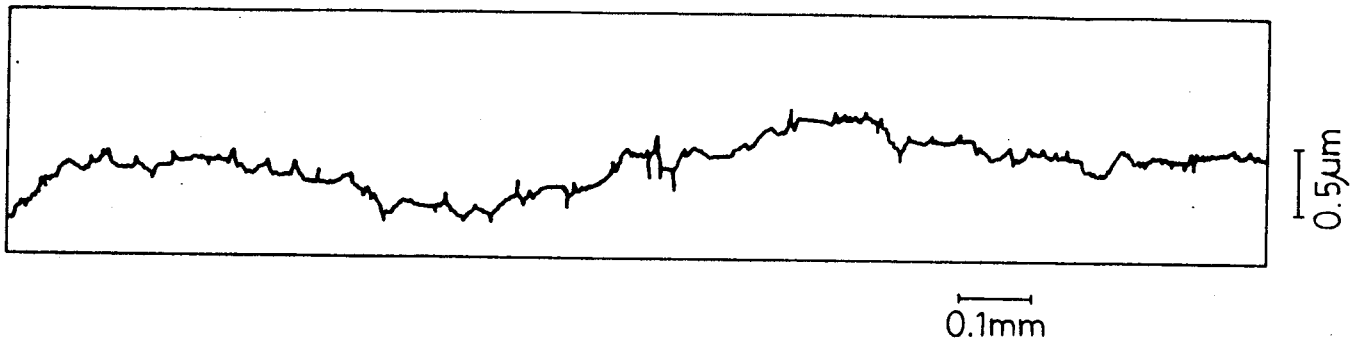
FIGS. 1-(*a*) and 1-(*b*) show profiles of the surface roughness of roping.

The characteristic constructural requirements of the present invention will now be described.

The means for controlling the occurrence of roping will be first described.

As pointed out hereinbefore, where a hot strip is cold-rolled, since crystal grains of the material before the cold rolling are small, the hot strip is substantially uniformly deformed as a whole even if the respective grains are different in the anisotropy of the plasticity, and thus roping does not occur. In contrast, in the case where a cast strip is cold-rolled, since the crystal grains are large, the quantity of the deformation in the thickness direction becomes uneven because of the anisotropy of the plasticity among the respective grains, and this unevenness appears as roping on the surface of the cold-rolled strip.

Accordingly, to make $\gamma$ grains of the cast strip finer, the thickness of the cast strip is kept not larger than 10 mm, the cast strip is cooled at a cooling rate of at least 50° C./sec in the temperature range from the solidification-initiating temperature to 1200° C., and the obtained cast strip is cold-rolled by using a hard roll having a surface hardness not lower than the Vickers hardness of 600 without carrying out the hot rolling. If this cooling rate is lower than 50° C./sec, $\gamma$ grains of the obtained cast strip are coarse, and even if the cold rolling is carried out by using a hard roll having a Vickers hardness not lower than 600, it is difficult to control the occurrence of roping. Nevertheless, after the temperature of the cast strip is lowered below 1200° C., a gradual cooling can be carried out at a cooling rate lower than 50° C./sec. Note, if the thickness of the cast strip exceeds 10 mm, it is industrially difficult to set the above-mentioned cooling rate at a level of at least 50° C./sec, but the casting conditions specified in the present invention can be industrially realized by appropriately selecting the cooling means and cooling medium for cooling the casting mold and cast strip. In the cast strip obtained by carrying out the casting under these conditions, the $\gamma$ grains become fine grains having an average diameter of less than 100 $\mu$m and a grain number of at least 4.

To prevent the occurrence of roping at the cold rolling of the cast strip, hard rolls having a surface hardness not lower than the Vickers hardness of 600 are used. If soft rolls having a Vickers hardness lower than 600 are used, even in the cast strip obtained under the above-mentioned conditions, it is difficult to control the occurrence of roping. Where the cold rolling is carried out at least two times with the intervening intermediate annealing , it is sufficient if a hard roll having a Vickers hardness not lower than 600 are used at the first cold rolling, because the grains of the cast strip to be subjected to the second cold rolling are recrystallized and made finer by the intermediate annealing.

Moreover, in the cold rolling, hard rolls having a surface hardness not lower than the Vickers hardness of 600 and Young's modulus of at least 30000 kgf/mm$^2$ are used for the cold rolling, the occurrence of roping can be controlled even without adopting the above-mentioned means of making the cast strip grains finer before the cold rolling.

According to this embodiment, undulations which will appear on the surface of the strip are controlled by using these hard rolls, which suffer little elastic deformation. When rolls having a surface hardness not lower than the Vickers hardness of 600 but a Young's modulus lower than 30000 kgf/mm$^2$ are used, the above-mentioned means making grains finer should be adopted. In rolls having a Young's modulus of at least 30000 kgf/mm$^2$, the surface hardness is generally not lower than the Vickers hardness of 600.

In the present invention, where the cold rolling is carried out at least two times with the intervening intermediate annealing, it is sufficient if rolls having a Young's modulus of at least 30000 kgf/mm$^2$ are used at the first cold rolling, because in the strip to be subjected to the second cold rolling. The grains are recrystallized and made finer by the intermediate annealing.

In the present invention, it is sufficient if the cold rolling is carried out in the temperature range where coloration by oxidation does not occur, and a "warm rolling" can be performed. After the cast strip is cold-rolled to the final product thickness, the rolled strip is processed to form a product such as 2B or BA by known means.

The cast strip having a thickness not larger than 10 mm can be subjected to the surface conditioning before, the cold rolling, according to need. This surface conditioning is accomplished by grinding, polishing, shot blasting, spraying of particles by high-pressure water, brushing, rolling under a slight pressure or pickling with an acid solution in which the dissolution rate is not substantially changed by the Cr content in the material, and by this surface conditioning, surface defects of the cast strip, such as convexities and concavities, deposited scales and the like, are moderated to an extent such that the cold rolling can be smoothly carried out without trouble. And the cast strip can be annealed.

The prevention of the appearance of the uneven gloss will now be described.

As pointed out hereinbefore, the uneven gloss appears when pickling, especially pickling with nitric acid-fluoric acid, is carried out. This uneven gloss can be prevented by cooling under appropriate conditions in the Cr carbide-precipitating temperature range before the pickling treatment. As the specific means, a method can be adopted in which the cast strip formed by casting, is cooled at a cooling rate of at least 10° C./sec in the temperature range of from 900° to 500° C., and then descaling is performed by pickling and then the cast strip is cold-rolled. As the preliminary treatment before pickling, a surface conditioning such as shot blasting and spraying of particles by high-pressure water can be adopted.

As a result, the appearance of uneven gloss can be prevented by the following mechanism.

An austenititic stainless steel strip before the cold rolling is generally descaled by pickling with nitric and fluoric acid. Since the dissolution rate of nitric and fluoric acid differs greatly according to the Cr content in the material, if Cr carbide is precipitated during the cooling, an intergranular corrosion readily occurs. If the cast strip is cold-rolled, the uneven gloss appears due to the influence of this intergranular corrosion. But if cooling is carried out under the above-mentioned conditions after the casting, Cr carbide is not precipitated, and therefore, there is no risk of an appearance of uneven gloss.

A method also can be adopted in which the cast strip is annealed at a temperature not lower than 1050° C., the cast strip is then cooled at a cooling speed of at least 10° C./sec in the temperature range of from 900° to 550° C., descaling is performed by pickling, and the cast strip is then cold-rolled. The annealing is carried out at a temperature not lower than 1050° C. so that the content of δ-ferrite left in the cast strip is reduced to as low a level as possible. The amount of the δ-ferrite phase also can be reduced by annealing after the cold rolling, but this annealing has an adverse influence on the processability and corrosion resistance of the product. Therefore, the δ-phase is reduced in advance while the material is still in the form of the cast strip. The cooling conditions are limited for the same reasons as described above.

According to this embodiment of the present invention, the uneven gloss does not appear, as in the foregoing embodiment. Moreover, since the cast strip prepared by casting is annealed, the content of δ-ferrite left in the product is greatly reduced, and therefore, the processability and corrosion resistance are improved.

Note, if the surface conditioning of the cast strip is carried out before the cold rolling instead of the above-mentioned pickling with nitric and fluoric acid, since the intergranular corrosion does not occur, the above-mentioned limitation of the cooling conditions for preventing the uneven gloss is not taken into consideration.

The present invention will now be described in detail with reference to the following examples, that by no means limit the scope of the invention.

Example 1

Each of austenitic stainless steels A, B, C and D comprising components shown in Table 1 was cast into a cast strip by a vertical twin-roll continuous casting machine of the internal water cooling type and the cast strip was cold-rolled to obtain strip or sheet products. The surface characteristics of the products prepared while changing such conditions as the thickness of the cast strip, the casting conditions, and the surface hardness of the roll used for the cold rolling are shown in Table 2.

In Table 2, the cooling rate in the temperature range from the solidification-initiating temperature to 1200° C. was changed by roll-cooling the cast strip coming from the twin rolls or by water-spray cooling, and the cooling rate in the temperature range of from 900° to 550° C. was changed by water-spray cooling. The surface hardness of the cold-rolling rolls was changed by the material of the rolls or the like. Rolls having a surface hardness Hv higher than 1200 were formed of tungsten carbide or prepared by thermal spraying of tungsten carbide on SKD steel. Rolls having a surface hardness Hv of 1000 were prepared by forming a hard Cr plating on SKD steel, rolls having a surface hardness Hv of 920 to 650 were formed of SKH steel and rolls having a surface hardness Hv lower than 550 were formed of SKD steel. The roll material used and the Young's modulus thereof are shown in Table 2. Roping of the product was judged based on the undulation height measured by a roughness meter, and the gloss was evaluated by naked eye observation.

In each of samples 1 through 6, the average γ grain size before the cold rolling was smaller than 100 μm, and since the cold rolling was carried out by using the hard roll having a Vickers hardness not lower than 600, roping did not occur. Note, if the undulation height shown in the roping column in Table 2 was smaller than 0.2 μm, it was judged that roping did not occur, and the product could be used without trouble.

In contrast, in samples 7 and 8 as comparative samples, the cooling conditions were appropriate and the γ grain size before the cold rolling was smaller than 100 μm, but since the surface hardness of the rolls used for the cold rolling were lower than the Vickers hardness of 600 and the rolls were a soft rolls, roping occurred. In samples 9 and 10, although the rolls used for the cold rolling were hard rolls having a surface hardness not lower than the Vickers hardness of 600, since the Young's modulus of the rolls were lower than 30000 kgf/mm$^2$ and the 7 grains were large because of a low cooling rate, roping occurred. In samples 9 through 12, the cooling rate in the temperature range of from 900° to 550° C. (the cooling rate at the annealing in samples 11 and 12) was low, intergranular corrosion was caused by pickling with nitric and fluoric acid, resulting in an uneven gloss.

Figure 1B:
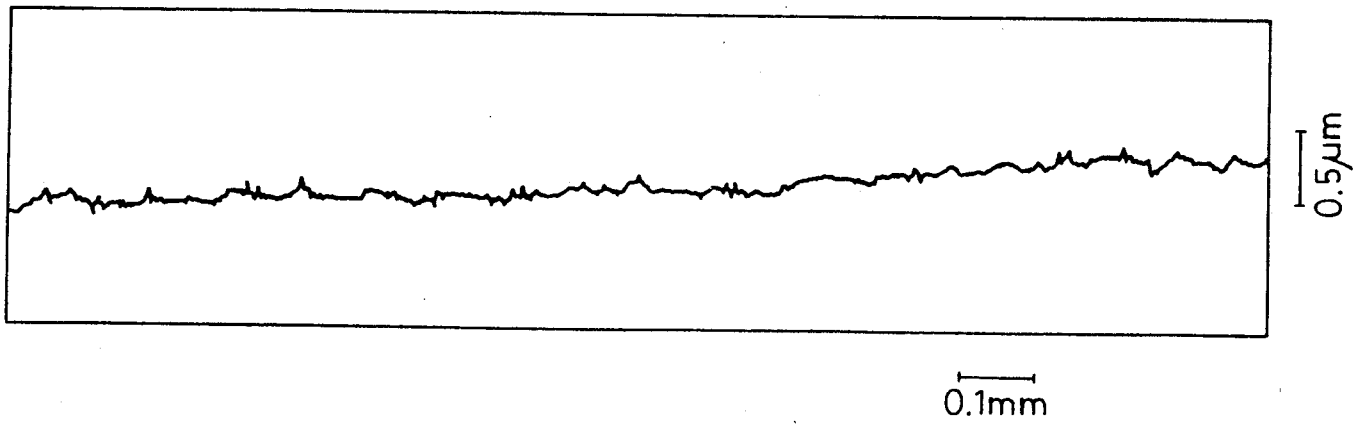

The surface roughness profiles, in the direction orthogonal to the rolling direction, of typical products where roping was caused and where roping did not occur are shown in FIGS. 1-(*a*) and 1-(*b*). Namely, FIG. 1-(*a*) shows the product where roping occurred and the undulation height was 0.5 μm (sample 9 in Table 2), and FIG. 1-(*b*) shows the product where roping did not occur and the undulation height was 0.15 μm (sample 4 in Table 2).

TABLE 1

| Kind of steel | Chemical Composition (% by weight) | | | | | | | | | | | |
|---|---|---|---|---|---|---|---|---|---|---|---|---|
| | C | Si | Mn | P | S | Cr | Ni | Mo | Cu | Al | O | M |
| A | 0.050 | 0.50 | 1.02 | 0.027 | 0.003 | 18.5 | 11.27 | 0.04 | 0.02 | 0.011 | 0.0062 | 0.044 |
| B | 0.050 | 0.50 | 1.01 | 0.027 | 0.004 | 18.3 | 8.90 | 0.07 | 0.02 | 0.015 | 0.0070 | 0.045 |
| C | 0.051 | 0.50 | 1.00 | 0.027 | 0.004 | 18.4 | 10.15 | 2.01 | 0.01 | 0.020 | 0.0070 | 0.045 |
| D | 0.050 | 0.50 | 1.00 | 0.027 | 0.005 | 18.4 | 7.20 | 0.04 | 0.01 | 0.020 | 0.0070 | 0.045 |

TABLE 1-continued

| Kind of steel | Chemical Composition (% by weight) | | | | | | | | | | | |
|---|---|---|---|---|---|---|---|---|---|---|---|---|
| | C | Si | Mn | P | S | Cr | Ni | Mo | Cu | Al | O | M |
| E | 0.060 | 0.65 | 1.03 | 0.027 | 0.005 | 18.3 | 8.90 | 0.04 | 0.12 | 0.025 | 0.0050 | 0.041 |

TABLE 2

| Sample No. | Kind of Steel | Thickness (mm) of Cast Strip | Cooling Rate (°C./sec) in Range of Solidification Temperature to 1200° C. | Cooling Rate (°C./sec) in Range of 900 to 550° C. | Annealing Temperature and Time and Cooling Rate* | Surface Conditioning before cold Rolling** | Average γ Grain Size (μm) before Cold Rolling | Reduction of Cold Rolling (%) | Cold Rolling Rolls Material*** | Cold Rolling Rolls Surface Hardness Hv | Cold Rolling Rolls Young's Modulus (kgf/mm²) | Roping Height (μm) | Uneven Gloss | Classification |
|---|---|---|---|---|---|---|---|---|---|---|---|---|---|---|
| 1 | A | 3.0 | 65–80 | 3–5 (air cooling) | — | grinding | 90 | 50<br>85 | WC<br>WC | 1400<br>1200 | 59000<br>53000 | 0.20<br>0.15 | good<br>good | present invention |
| 2 | B | 3.3 | 95–110 | 3–5 (air cooling) | — | grinding | 70 | 50<br>85 | SKD + Cr plating<br>powdery high speed tool steel | 1000<br>920 | 21000<br>25000 | 0.20<br>0.20 | good<br>good | present invention |
| 3 | B | 3.3 | 95–110 | 15–35 | — | NID + pickling with nitric and fluoric acid | 70 | 50<br>85 | SKD + Cr plating<br>powdery high speed tool steel | 1000<br>920 | 21000<br>25000 | 0.20<br>0.20 | good<br>good | present invention |
| 4 | C | 4.5 | 150–200 | 10–30 | — | shot blasting + pickling with nitric and fluoric acid | 55 | 50<br>85 | SKH<br>SKH | 820<br>650 | 21000<br>21000 | 0.10<br>0.15 | good<br>good | present invention |
| 5 | B | 3.3 | 95–110 | 3–5 (air cooling) | 1100° C. × 30 sec 10–30° C./sec | NID + pickling with nitric and fluoric acid | 70 | 50<br>85 | SKD + Cr plating<br>powdery high speed tool steel | 1000<br>920 | 21000<br>25000 | 0.20<br>0.20 | good<br>good | present invention |
| 6 | D | 1.2 | 60–70 | 5–7 (air cooling) | 1150° C. × 30 sec 10–30° C./sec | shot blasting + pickling with nitric and fluoric acid | 95 | 50<br>85 | WC<br>WC | 1650<br>1400 | 64000<br>59000 | 0.20<br>0.15 | good<br>good | present invention |
| 7 | A | 3.0 | 65–80 | 3–5 (air cooling) | — | grinding | 90 | 50<br>85 | SKD<br>SKD | 550<br>450 | 21000<br>21000 | 0.70<br>0.60 | good<br>good | com-parison |
| 8 | B | 3.3 | 95–110 | 3–5 (air cooling) | — | grinding | 70 | 50<br>85 | SKD<br>SKD | 550<br>450 | 21000<br>21000 | 0.45<br>0.40 | good<br>good | com-parison |
| 9 | B | 3.3 | 20–30 | 3–5 (air cooling) | — | NID + pickling with nitric and fluoric acid | 150 | 50<br>85 | SKD + Cr plating<br>powdery high speed tool steel | 1000<br>920 | 21000<br>25000 | 0.45<br>0.50 | bad<br>bad | com-parison |
| 10 | C | 4.5 | 35–45 | 3–5 (air cooling) | — | shot blasting + pickling with nitric and fluoric acid | 200 | 50<br>85 | SKD + thermal spraying of WC<br>SKD + thermal | 1400 parison<br>1200 | 21000<br>21000 | 0.50<br>0.45 | bad<br>bad | com- |

TABLE 2-continued

| Sample No. | Kind of Steel | Thickness (mm) of Cast Strip | Cooling Rate (°C./sec) in Range of Solidification Temperature to 1200° C. | Cooling Rate (°C./sec) in Range of 900 to 550° C. | Annealing Temperature and Time and Cooling Rate* | Surface Conditioning before cold Rolling** | Average γ Grain Size (μm) before Cold Rolling | Reduction of Cold Rolling (%) | Cold Rolling Rolls Material*** | Cold Rolling Rolls Surface Hardness Hv | Cold Rolling Rolls Young's Modulus (kgf/mm²) | Roping Height (μm) | Uneven Gloss | Classification |
|---|---|---|---|---|---|---|---|---|---|---|---|---|---|---|
| | | | | | | | | | spraying of WC | | | | | |
| 11 | B | 3.3 | 95–110 | 15–35 | 1100° C. × 30 sec 3–5° C./sec (air cooling) | NID + pickling with nitric and fluoric acid | 70 | 50<br>85 | SKD + Cr plating<br>powdery high speed tool steel | 1000<br>920 | 21000<br>25000 | 0.20<br>0.20 | bad<br>bad | com-parison |
| 12 | D | 1.2 | 65–70 | 10–30 | 1150° × 30 sec 5–7° C./sec (air cooling) | shot blasing + pickling with nitric and fluoric acid | 95 | 50<br>85 | WC<br>WC | 1650<br>1400 | 64000<br>59000 | 0.20<br>0.15 | bad<br>bad | com-parison |

Note
*cooling rate was in the range of from 900 to 550° C.
**NID means spraying of particles by high-pressure water.
***WC means tungsten carbide, SKD means die tool steel, and SKH means high speed tool steel.

EXAMPLE 2

Austenitic stainless steels C and E comprising components shown in Table 1 were each cast into a cast strip by a vertical twin-roll continuous casting machine of the internal water cooling type, and the cast strip was cold-rolled to obtain strip and sheet products. The surface characteristics of products prepared while changing conditions such as the thickness of the cast strip, the casting conditions, and the surface hardness of the rolls used for the cold rolling are shown in Table 3.

In Table 3, in the range of from the solidification-initiating temperature to 1200° C., the cooling rate was not controlled, but in the range of from 900° to 550° C., the cooling rate was changed by water spraying. As the material of the cold rolling rolls, tungsten carbide, a ceramic material (composed mainly of $Si_3N_4$), SKH and powdery high speed tool steel were used. The Young's modulus of tungsten carbide, the ceramic material, SKH steel and powdery high speed tool steel were 57000 to 64000, 31000, 21000 and 25000 kgf/mm$^2$, respectively.

In each sample, the average $\gamma$ grain size before the cold rolling was larger than 100 $\mu$m. In samples 13 through 19 of the present invention, since the cold rolling was carried out by using a hard roll having a Young's modulus of at least 30000 kgf/mm$^2$, roping did not occur. In samples 13 through 15, although cooling was effected by air cooling in the Cr carbide-depositing temperature range, since grinding was carried out as a preliminary treatment before the cold rolling, an uneven gloss was not observed. Furthermore, in samples 16 through 19, since cooling was carried out at a cooling rate of at least 10° C./sec in the above-mentioned temperature range, even if pickling was carried out with nitric and fluoric acid, an uneven gloss was not observed. In contrast in samples 20 and 21 as comparative samples, since the Young's modulus of the rolls used for the cold rolling was lower than 30,000 kgf/mm$^2$, roping occurred, but since grinding was carried out as the surface conditioning before the cold rolling, the uneven gloss was controlled. In samples 22 and 23, since rolls having a Young's modulus of at least 30000 kgf/mm$^2$ were used for the cold rolling, roping did not occur, but since the cooling was carried out at a cooling rate lower than 10° C./sec in the Cr carbide-depositing temperature range, and pickling with nitric and fluoric acid was carried out as the surface conditioning before the cold rolling, the uneven gloss was conspicuous.

TABLE 3

| Sample No. | Kind of Steel | Thickness (mm) of Cast Strip | Cooling Rate (°C./sec) in Range of Solidification - Initiating Temperature to 1200° C. | Cooling Rate (°C./sec) in Range of 900 to 500° C. | Annealing Temperature × Time, Cooling Rate | Surface Conditioning before cold Rolling | Average γ Grain Size (∞m) before Cold Rolling | Reduction of Cold Rolling (%) | Cold Rolling Roll | | | Roping, Undulation Height (μm) | Uneven Gloss | Classi-fication |
|---|---|---|---|---|---|---|---|---|---|---|---|---|---|---|
| | | | | | | | | | Material | Young's Modulus (kgf/mm²) | Surface Hardness Hv | | | |
| 13 | C | 4.5 | 10-15 | 3-5 (air cooling) | — | grinding | 200 | 85 | WC | 57000 | 1400 | 0.15 | good | present invention |
| 14 | C | 4.5 | 10-15 | 3-5 (air cooling) | — | grinding | 200 | 70 | WC | 64000 | 1650 | 0.15 | good | present invention |
| 15 | E | 2.2 | 20-30 | 4-6 (air cooling) | — | grinding | 150 | 80 | WC | 60000 | 1500 | 0.15 | good | present invention |
| 16 | C | 4.5 | 10-15 | 10-30 | — | NID + pickling with nitric and fluoric acid | 200 | 85 | ceramics | 31000 | 1500 | 0.15 | good | present invention |
| 17 | E | 2.2 | 20-30 | 10-30 | — | NID + pickling with nitric and fluoric acid | 150 | 80 | ceramics | 31000 | 1500 | 0.15 | good | present invention |
| 18 | C | 4.5 | 10-15 | 3-5 (air cooling) | 1500° C. × 30 sec 10-30° C./sec | NID + pickling with nitric and fluoric acid | 200 | 85 | WC | 57000 | 1400 | 0.15 | good | present invention |
| 19 | E | 2.2 | 20-30 | 4-6 (air cooling) | 1150° C. × 30 sec 10-30° C./sec | NID + pickling with nitric and fluoric acid | 150 | 80 | WC | 60000 | 1500 | 0.15 | good | present invention |
| 20 | C | 4.5 | 10-15 | 3-5 (air cooling) | — | grinding | 200 | 70 | SKH | 21000 | 680 | 0.60 | good | com-parison |
| 21 | E | 2.2 | 20-30 | 4-6 (air cooling) | — | grinding | 150 | 80 | powdery high speed steel | 25000 | 950 | 0.50 | good | com-parison |
| 22 | C | 4.5 | 10-15 | 3-5 (air (cooling) | — | NID + pickling with nitric and fluoric acid | 200 | 85 | WC | 57000 | 1400 | 0.15 | bad | com-parison |
| 23 | C | 4.5 | 10-15 | 10-30 | 1150° C. × 30 sec 3-5° C./sec | NID + pickling with nitric and fluoric acid | 200 | 85 | WC | 57000 | 1400 | 0.15 | bad | com-parison |

As apparent from the foregoing description, according to the present invention, in the producing cold rolled strips and sheets of austenitic stainless steel by cold-rolling a cast strip having a thickness close to the product thickness, which is prepared by the continuous casting, since the total reduction ratio required for obtaining the product is small, the problems concerning the surface quality can be solved, and therefore, a hot strip mill becomes necessary and strong effects of shortening the steps and saving energy can be obtained. Moreover, since the total reduction ratio is small, development of the aggregate structure is inhibited, and therefore, an effect of preventing earing is obtained when the product is subjected to draw forming. Still further, in the obtained strips and sheets, roping and gloss unevenness do not occur, and thus a product having excellent surface conditions can be provided.

We claim:

1. A process of producing cold-rolled strips and sheets of austenitic stainless steel, which comprises preparing a cast strip having a thickness not larger than 10 mm, which is composed of an austenitic stainless steel, by a continuous casting machine, in which the wall surface of a casting mold moves synchronously with the cast strip, descaling by pickling, and cold rolling the cast strip by hard rolls having a surface hardness not lower than a Vickers hardness of 600 at a 10 kg load.

2. A process according to claim 1, wherein in the continuous casting machine, cooling is carried out at a cooling rate of at least 50° C./sec in the temperature range of from the temperature for initiation of solidification of the cast strip to 1200° C., and the obtained cast strip is cold-rolled by using said hard rolls.

3. A process according to claim 1, wherein the cast strip is cold-rolled by using said hard rolls having a Young's modulus of at least 30000 kgf/mm$^2$.

4. A process according to claim 1, wherein in the continuous casting machine, cooling is carried out at a cooling rate of at least 50° C./sec in the temperature range of from the temperature for initiation of solidification of the cast strip to 1200° C., and at a cooling rate of at least 10° C./sec in the temperature range of from 900 to 550° C., the cooled cast strip is descaled by pickling, and the descaled cast strip is cold-rolled by using said hard rolls.

5. A process according to claim 1, wherein in the continuous casting machine, cooling is carried out at a cooling rate of at least 10° C./sec in the temperature range of from 900° to 550° C., the cooled cast strip is descaled by pickling, and the descaled cast strip is cold-rolled by using said hard rolls having a Young's modulus of at least 30000 kgf/mm$^2$.

6. A process according to claim 1, wherein in the continuous casting machine, cooling is carried out at a cooling rate of at least 50° C./sec in the temperature range of from the temperature for initiation of solidification of the cast strip to 1200° C., and the obtained cast strip is annealed under a condition of heating at a temperature range not lower than 1050° C. and cooling the annealed strip at a cooling rate of at least 10° C./sec in the temperature range of 900° C. to 550° C., the cooled cast strip is descaled by pickling, and the descaled cast strip is cold-rolled by using said hard rolls.

7. A process according to claim 1, wherein the cast strip formed by the continuous casting machine is annealed under a condition of heating at a temperature of not lower than 1050° C. and cooling the annealed strip at a cooling rate of at least 10° C./sec in the temperature range of 900° to 550° C., the cooled cast strip is descaled by pickling, and the descaled cast strip is cold-rolled by using said hard rolls having a Young's modulus of at least 30000 kgf/mm$^2$.

* * * * *